United States Patent [19]

Baysinger et al.

[11] Patent Number: 5,005,781

[45] Date of Patent: Apr. 9, 1991

[54] IN-FLIGHT RECONFIGURABLE MISSILE CONSTRUCTION

[75] Inventors: Scott D. Baysinger, Chatsworth; Ralph H. Klestadt, Encino, both of Calif.

[73] Assignee: Hughes Aircraft Company, Los Angeles, Calif.

[21] Appl. No.: 328,828

[22] Filed: Mar. 27, 1989

[51] Int. Cl.[5] ..... F42B 10/12

[52] U.S. Cl. ..... 244/3.26

[58] Field of Search ..... 244/3.26, 3.1; 102/377, 102/378; 60/225

[56] References Cited

U.S. PATENT DOCUMENTS

| | | | |
|---|---|---|---|
| 1,257,126 | 2/1918 | Schneider | 244/3.26 |
| 2,344,957 | 3/1944 | Anzalone | 244/3.26 |
| 3,125,957 | 3/1964 | Lipinski | 244/3.26 |
| 3,167,016 | 1/1965 | Czerwinski | 102/377 |
| 3,377,952 | 4/1968 | Crockett | 102/377 |
| 3,491,692 | 1/1970 | Blankenagel | 102/378 |
| 3,601,055 | 8/1971 | Crockett | 102/378 |
| 4,708,304 | 11/1987 | Wederetz et al. | 244/3.26 |

FOREIGN PATENT DOCUMENTS

| | | | |
|---|---|---|---|
| 1298369 | 6/1969 | Fed. Rep. of Germany | 102/377 |

*Primary Examiner*—Charles T. Jordan
*Assistant Examiner*—Michael J. Carone
*Attorney, Agent, or Firm*—R. M. Heald; R. A. Hays; W. Denson-Low

[57] ABSTRACT

A staged missile which is reconfigured in-flight solely by changing vehicle dynamics enabling packaging of kinetric energy kill capability in severely constrained envelopes, thus retaining the use of existing tactical assets to counter advanced armored threats.

4 Claims, 3 Drawing Sheets

IN-FLIGHT RECONFIGURABLE MISSILE CONSTRUCTION

BACKGROUND OF THE INVENTION

1. Field of the Invention

The present invention relates generally to a missile construction, and, more particularly, to a missile construction which is capable of in-flight reconfiguration automatically occurring as a result of the forces generated by the vehicle dynamics.

2. Background of the Invention

Many missiles have been of a one-piece construction including a rocket motor at one end onto which is affixed either a centrally or aft located control section, and the payload forming the opposite end. The overall missile length in this case is fixed and consists simply of the addition of the individual part lengths. Accordingly, launch facilities to handle such missiles must be able to accommodate the fixed missile dimensions.

Still other known rocket constructions, referred to as "staged" rockets, provide means for improving vehicle flight performance by separating rocket motors from the control and payload sections upon propellant exhaustion. Again, at launch the overall missile length is fixed requiring correspondingly sized platforms and launchers.

In the future, missiles will be required to counter increasingly capable threats yet remain compatible with existing support equipment. It is therefore essential to provide a missile construction which would substantially reduce necessary overall length at the time of launch without impairing function or reliability.

In addition, a continuing matter of concern in all missiles is the provision of aerodynamic stability. In the past, an approach to static stabilization was to deploy aerodynamic surfaces which may be undesirable in that the surfaces can increase drag, lack reliability, or constrain total size. Dynamic stabilization has been achieved by inducing high spin rates, either aerodynamically or by other means, but this tends to only further complicate system design in a maneuvering vehicle. Any solution for solving the overall length problem of a missile must, therefore, not detrimentally affect aerodynamic stability.

SUMMARY AND OBJECTS OF THE PRESENT INVENTION

A primary aim and object of the invention is utilization of the differential between aerodynamic and inertial forces existing upon missile boost completion to effect automatic reconfiguration.

A further object of the present invention is to provide a missile construction which has a reduced overall prelaunch length as compared to that of a conventionally constructed vehicle.

A further object is the provision of a missile construction enabling carrying missile payloads or propellants in increased amount without violating missile envelope constraints or reducing performance.

Briefly, in accordance with the present invention a missile construction is provided which includes a staged rocket motor having an elongated axially extending cavity in the forward end thereof. A control module has an opening extending completely therethrough which aligns with the rocket motor cavity. The payload is in the general shape of a cylinder or penetrator rod which is slidingly received through the corresponding opening in the control module and prior to launch is received within the rocket motor cavity.

By the described arrangement and construction, the overall length of the missile at launch time is only slightly more than the sum of the staged rocket motor and control module lengths, in that a major part of the payload is located within the rocket motor cavity. After launch and at completion of the rocket motor operation, inertial forces which previously held the rod and control module against the motor now act to immediately and automatically jettison the spent motor. By similar considerations the penetrator rod moves forward through the opening of the control module and has an end portion wedged therein by virtue of a flared end. The control module and payload then proceed to the target with significantly lower aerodyamic drag and favorable stability characteristics.

The payload does not need to be rigidly secured in the axial direction, because boost acceleration keeps the payload in place. Also, the control section is an annular configuration which allows it to slide over the payload until it rests against and is driven by the rocket motor. Moreover, since the control module is self-contained, there is no need for auxiliary electrical harnesses.

During boost phase, the center of mass location provides a desirable margin of stability. Inertial forces produced by boost acceleration prevent axial movement of the missile parts relative to one another. However, on completion of the boost phase, a substantial mismatch exists between aerodynamic and inertial forces. That is, since boost burnout occurs at a high vehicle speed, this implies correspondingly large aerodynamic drag forces which in the present case means that the rocket booster and control module experience greater drag loading than the payload. On the other hand, inertial forces are a function of body density so that the payload inertia is large as compared to the control module and spent booster.

Accordingly, at the end of boost the empty booster is jettisoned, and the payload slides forward through the control module (or, the control module translates aft along the payload), insuring an aerodynamically stable airframe. A precision taper between the control module and payload contacting surfaces produces a secure interference fit.

A missile of the described architecture can be accommodated by existing launch facilities designed to handle missiles having a length just slightly more than the rocket motor and control module taken together, although the effective missile length is actually greater than that by an amount equal to the payload length.

DESCRIPTION OF A PREFERRED EMBODIMENT

Figure 1:
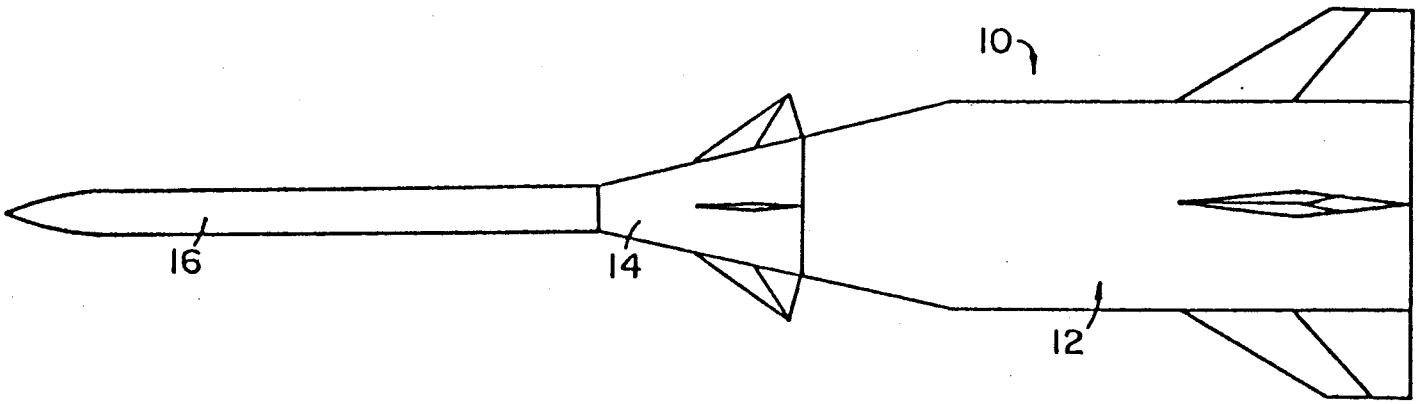
FIG. 1. (PRIOR ART)
FIG. 1 is a side elevational view of a prior art missile.

Turning now to the drawings and particularly FIG. 1 there is shown, in side elevational view, a typical missile 10 of the prior art which is seen to consist generally of three major parts, namely, a rocket motor 12 located at one end, a centrally located control section 14, and a payload 16. In certain cases, all of the missile parts remain secured together and support launching facilities, of course, have to accommodate the entire length which consists essentially of the sum of the part lengths measured end-to-end. Even in other cases where the rocket motor separates from the remainder of the missile after boost, the initial missile length is the same as that just immediately prior to separation.

Figure 2A:
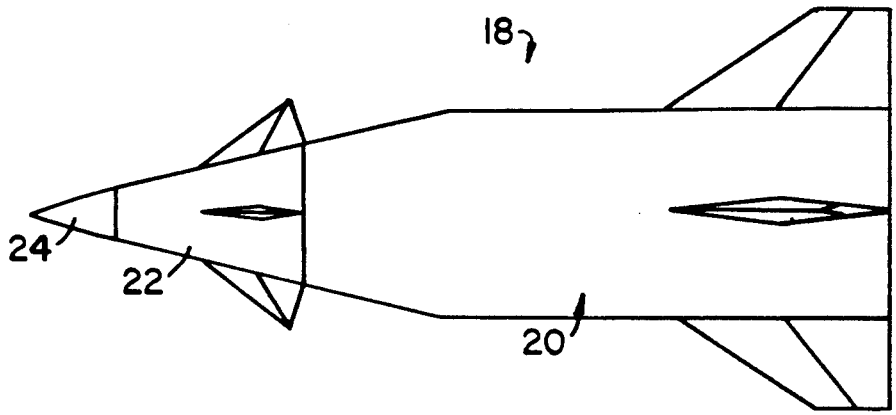
FIGS. 2A–C depict side elevational views of a missile of the present invention at the time of launch, at the conclusion of boost, and after in-flight reconfiguration.

FIG. 2A depicts in side elevational view a missile 18 constructed in accordance with the present invention at the time of launch which is seen to include a rocket motor 20, a control section 22 and a payload 24, the latter consisting generally of an elongated penetrator rod a major part of which is stored within the missile at this time.

Figure 2B:
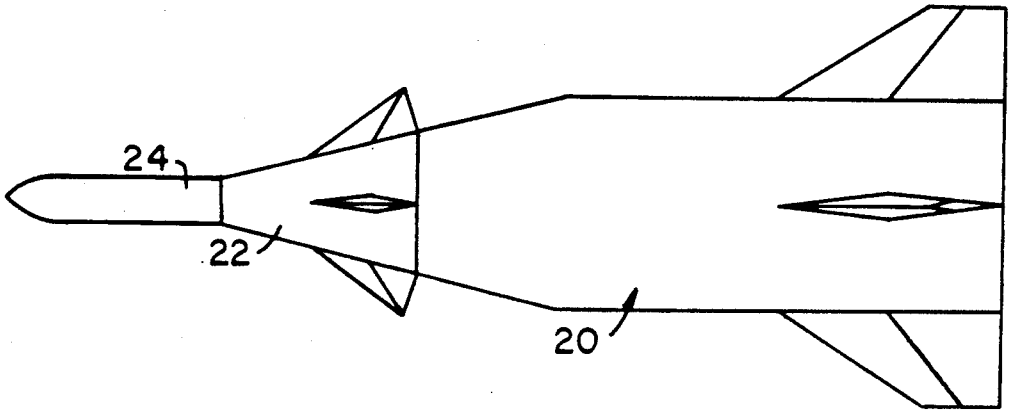
Figure 2C:
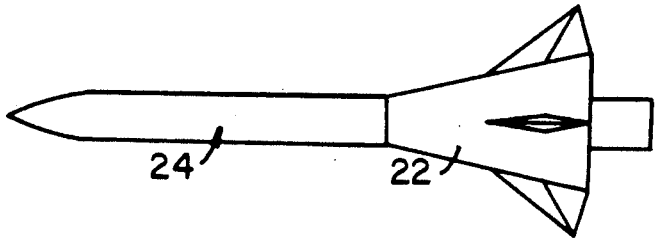

As shown in FIG. 2B, near the conclusion of boost the rocket motor 20 and control module translate aft along the rod resulting in the rocket motor separating from the remainder allowing the payload and control section to proceed to the target as a unit. FIG. 2C shows the missile control section and payload immediately after automatic reconfiguration. At this time, as a result of payload and control section interaction, the payload now extends forwardly from the control section a substantially greater amount.

Figure 3:
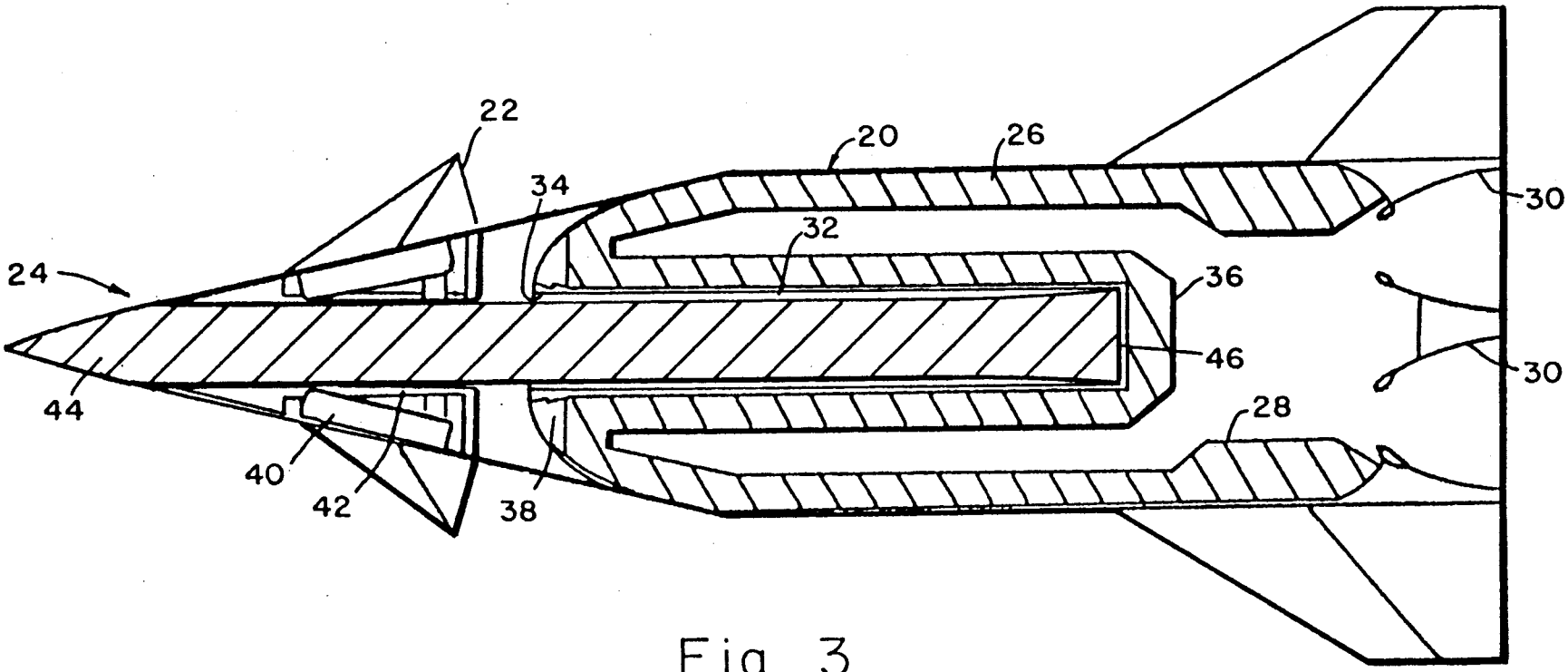
FIG. 3 is a side elevational, sectional view of the present invention taken along line 3—3 of FIG. 2A.

For the ensuing details of missile construction, reference is now made to FIG. 3. As shown there the rocket motor 20 includes a case, insulation, solid propellant 26, ignition system, and exhaust nozzles 30 in conventional manner. A cavity is defined by a generally cylindrical shell 32 integrated with the forward end of housing 20, the longitudinal axis of which is aligned with the rocket motor axis. More particularly, the shell 32 has an open outer end 34, a closed inner end 36, and is bonded to the motor case 38. Although other materials may be found to be satisfactory, preferably the shell 32 is constructed of material having a smooth inner wall surface and, as well, has such physical heat characteristics as to enable maintaining dimensional and geometric integrity during boost.

The control section 22 is generally cylindrical in shape with an axial opening 40 extending therethrough. Specifically, the opening has a diameter slightly less than that of the shell 32 for a purpose that will be clarified later. Preferably, the opening 40 is defined by a smooth surfaced tube 42.

The payload 16 is preferably in the form of a cylindrical penetrator rod 44 of circular or other geometric cross section. More particularly, the penetrator rod has a constant outer diameter over most of the rod length such as to enable sliding within the tube 40 and a radially outwardly flared end portion 46 of such a dimension as to prevent it passing through the tube 40. The flared end portion 46 is, however, of such a dimension to enable sliding receipt within the rocket motor shell 32.

In operation, the missile parts at launch are arranged as shown in FIG. 3 with the penetrator rod fully seated within shell 32 and the flared end portion 40 contacting the shell inner end. This arrangement continues throughout the boost phase. On the rocket motor burnout, the reaction forces cause the penetrator rod to move forward sliding along the tube 40 until the rod flared end portion achieves an interference fit with the tube end. In this final configuration, the penetrator rod is at its forwardmost position as shown in FIG. 2C which position continues with the penetrator rod and control section proceeding as a unit to the target.

Although the present invention is described in connection with a preferred embodiment, it is to be understood that various changes and modifications may be made therein and still come within the spirit of the invention. For example, instead of the payload having a flared end portion 46 other limiting means can be used such as radially extending latches on the payload which obstructingly engage the control module on the payload moving forward relative to the control module on boost completion.

What is claimed is:

1. A staged missile assembly for attacking a target, comprising:

a rocket motor assembly having a forward end, an aft end and a cavity extending part way through said rocket motor assembly from said forward end;

an aerodynamic control section releasably mounted on the forward end of said rocket motor assembly, said control section including a tubular opening of uniform cross-section aligned with said cavity;

a penetrator rod payload, said penetrator rod including a first part slidably disposed within said control section and a second part slidably disposed within said cavity, said second part having an outwardly flared end portion formed with an external cross-section less than said cross-section of said cavity and greater than the cross-section of said tubular opening through said control section wherein jettisoning of said rocket motor assembly causes relative movement between said penetrator rod and said control section until said outwardly flared end is wedged into extended surface gripping contact and an increasingly tighter interference fit with said tubular opening, insuring said penetrator rod and said control section proceed as a unit toward a specified target.

2. A missile as in claim 1, in which the penetrator rod payload first part is a cylindrical rod of substantially uniform diameter.

3. A missile as in claim 1 in which the rocket motor cavity is defined by a cylindrical component having an open end facing outwardly and closed inner end located within the rocket motor.

4. A missile as in claim 3, in which the payload second part rests on a metal cylinder closed inner end of said cavity at launch.

* * * * *